US009021829B2

(12) United States Patent
Jung et al.

(10) Patent No.: US 9,021,829 B2
(45) Date of Patent: May 5, 2015

(54) OUTDOOR UNIT FOR AIR CONDITIONER

(75) Inventors: Mijin Jung, Seoul (KR); Dongsoo Moon, Seoul (KR); Samchul Ha, Seoul (KR)

(73) Assignee: LG Electronics Inc., Seoul (KR)

( * ) Notice: Subject to any disclaimer, the term of this patent is extended or adjusted under 35 U.S.C. 154(b) by 468 days.

(21) Appl. No.: 13/223,328

(22) Filed: Sep. 1, 2011

(65) Prior Publication Data

US 2012/0055186 A1 Mar. 8, 2012

(30) Foreign Application Priority Data

Sep. 6, 2010 (KR) ..... 10-2010-0086825

(51) Int. Cl.

| | |
|---|---|
| ***F25D 17/04*** | (2006.01) |
| ***E06B 3/94*** | (2006.01) |
| ***F24F 1/48*** | (2011.01) |
| ***F24F 13/12*** | (2006.01) |
| ***F24F 13/14*** | (2006.01) |

(52) U.S. Cl.

CPC . *F24F 1/48* (2013.01); *F24F 13/12* (2013.01); *F24F 13/1413* (2013.01); *F24F 13/1486* (2013.01)

(58) Field of Classification Search

CPC ..... E06B 3/5009; E06B 7/086; E06B 9/0653; E06B 3/5036; E06B 7/08; E06B 7/082

USPC ..... 62/409; 160/134; 454/313–319, 454/322–327, 254–258, 273–274, 299–300, 454/309–310, 312; 49/38–39, 41, 73.1, 49/74.1

See application file for complete search history.

(56) References Cited

U.S. PATENT DOCUMENTS

| | | | | |
|---|---|---|---|---|
| 2,355,294 | A * | 8/1944 | Herbster | 49/41 |
| 2,600,926 | A * | 6/1952 | Rudd | 454/308 |
| 2,901,961 | A * | 9/1959 | Cotts | 49/77.1 |
| 3,649,069 | A * | 3/1972 | Zip | 296/97.7 |
| 4,739,816 | A * | 4/1988 | Dodich et al. | 160/168.1 R |
| 4,766,806 | A | 8/1988 | Tomiser, Jr. et al. | |
| 5,448,860 | A * | 9/1995 | Menke et al. | 52/80.1 |
| 5,910,045 | A * | 6/1999 | Aoki et al. | 454/186 |
| 5,947,373 | A * | 9/1999 | Saito et al. | 237/2 B |
| 6,019,155 | A * | 2/2000 | Daoud | 160/134 |
| 6,807,772 | B2 * | 10/2004 | Halter | 49/39 |
| 6,974,378 | B2 * | 12/2005 | Osada et al. | 454/155 |

(Continued)

FOREIGN PATENT DOCUMENTS

| | | |
|---|---|---|
| EP | 1 777 470 | 4/2007 |
| JP | 5-288368 | 11/1993 |

(Continued)

OTHER PUBLICATIONS

European Search Report dated Dec. 3, 2012.

*Primary Examiner* — Cassey D Bauer
*Assistant Examiner* — Steve Tanenbaum
(74) *Attorney, Agent, or Firm* — KED & Associates, LLP

(57) ABSTRACT

An outdoor unit for an air conditioner according to an exemplary embodiment of the disclosure, comprising: a case forming shape and having a suction port suctioning outside air and a discharge port discharging the suctioned air; a heat exchanger accommodated inside the case; a fan that is accommodated inside the case and forcibly circulate air; and a louver assembly revolvably mounted in the case so as to selectively open and close the discharge port.

3 Claims, 10 Drawing Sheets

(56) References Cited

U.S. PATENT DOCUMENTS

| | | | | |
|---|---|---|---|---|
| 2005/0023863 | A1* | 2/2005 | Stull | 296/193.1 |
| 2007/0190927 | A1* | 8/2007 | Bash et al. | 454/327 |

FOREIGN PATENT DOCUMENTS

| | | |
|---|---|---|
| JP | 2000-161715 | 6/2000 |
| JP | 2001-174001 | 6/2001 |

* cited by examiner

OUTDOOR UNIT FOR AIR CONDITIONER

CROSS REFERENCE TO RELATED APPLICATION

The present application claims priority under 35 U.S.C. 119 and 35 U.S.C. 365 to Korean Patent Application No. 2010-0086825 (filed on Sep. 6, 2010), which is hereby incorporated by reference in its entirety.

BACKGROUND OF THE INVENTION

1. Technical Field

The present disclosure relates to an outdoor unit for an air conditioner.

2. Description of the Related Art

Generally, the air conditioner is an apparatus for cooling or heating air based on a refrigeration cycle including a compressor, a condenser, an evaporator and an expansion member.

One of the condenser and the evaporator that is placed outdoors is heat-exchanged with outside air and the heat exchanger placed outdoors is called an outdoor unit.

The heat exchanger situated inside the outdoor unit and an outdoor fan suctioning outdoor air to the inside of the outdoor unit and discharging to the outside of the outdoor unit are mounted.

For a general outdoor unit, the outdoor fan is mounted in the rear of the discharge port and the heat exchanger performing a function of the condenser or the evaporator is placed in the rear of the outdoor fan.

A grille is formed in the discharge port of the outdoor unit, such that the introduction of foreign substance from the outside or the entrance of person's hands is prevented. Since the discharge port of an existing outdoor unit is maintained in opened condition regardless of whether or not the operation of the outdoor, when the outdoor unit is not operating, there is a disadvantage that the foreign substance is introduced into the inside of the outdoor unit via the discharge port. Particularly, in the desert regions, small particles of sand is introduced into the inside of the outdoor unit to degrade the operating performance of the outdoor unit.

SUMMARY OF THE INVENTION

The disclosure proposed to improve above disadvantage is to provide opening and closing structure of the discharge port of the outdoor unit in which the discharge port of the outdoor unit is closed when not operating the outdoor unit and is opened only when operating the outdoor unit.

An outdoor unit for an air conditioner according to an exemplary embodiment of the disclosure to achieve above objects, comprising: a case forming shape and having a suction port suctioning outside air and a discharge port discharging the suctioned air; a heat exchanger accommodated inside the case; a fan that is accommodated inside the case and forcibly circulate air; and a louver assembly rotatably mounted in the case so as to selectively open and close the discharge port.

An outdoor unit for an air conditioner according to an exemplary embodiment of the disclosure including above configuration may obtain the same effects as below.

First, since the discharge port of the outdoor unit is opened only when operating the outdoor unit, the introduction of the foreign substance may be prevented via the discharge port when not operating the outdoor unit.

Further, when the discharge port of the outdoor unit is selectively closed by the louvers and the louvers close the discharge port of the outdoor unit, an advertisement or a picture may be attached to the surface of the louver, such that there is an advantage that may beautifully design a shape of the outdoor unit. In other words, there is a advantage that may use the front of the outdoor unit as an advertising board.

DESCRIPTION OF THE PREFERRED EMBODIMENTS

Hereinafter, an outdoor unit of an air conditioner in an exemplary embodiment of the disclosure will be described in detail with reference to the drawings.

Figure 1:
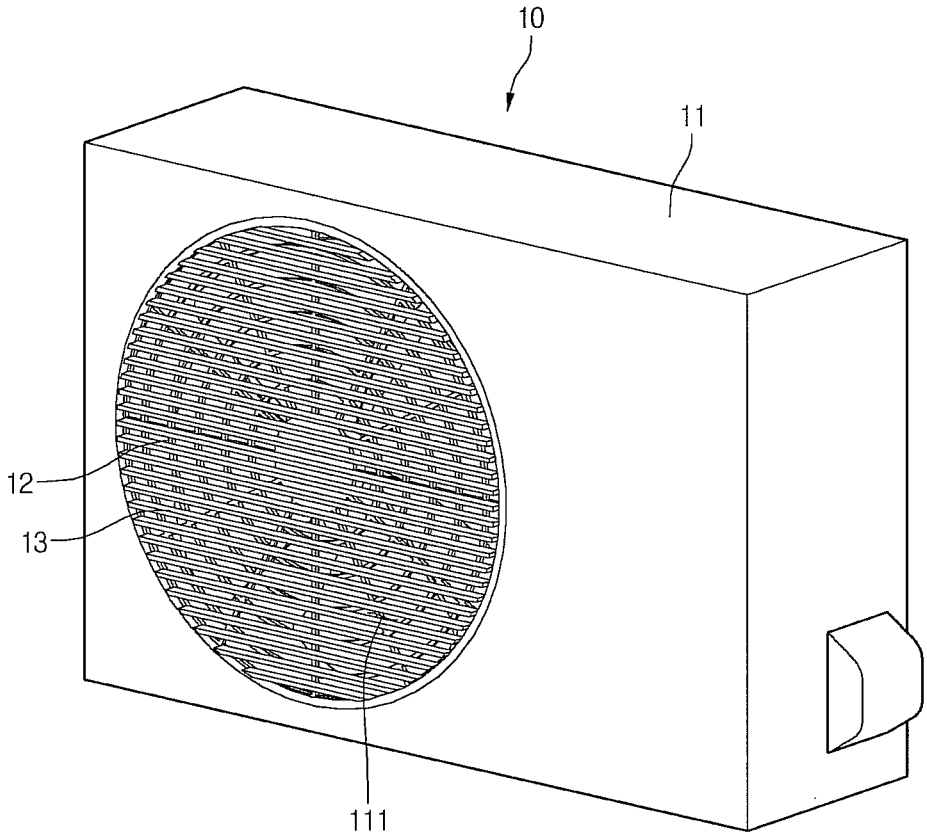
FIG. 1 is a front perspective view of an outdoor unit showing a condition in which a discharge port is opened, as an outdoor unit for an air conditioner according to an exemplary embodiment of the disclosure.
Figure 2:
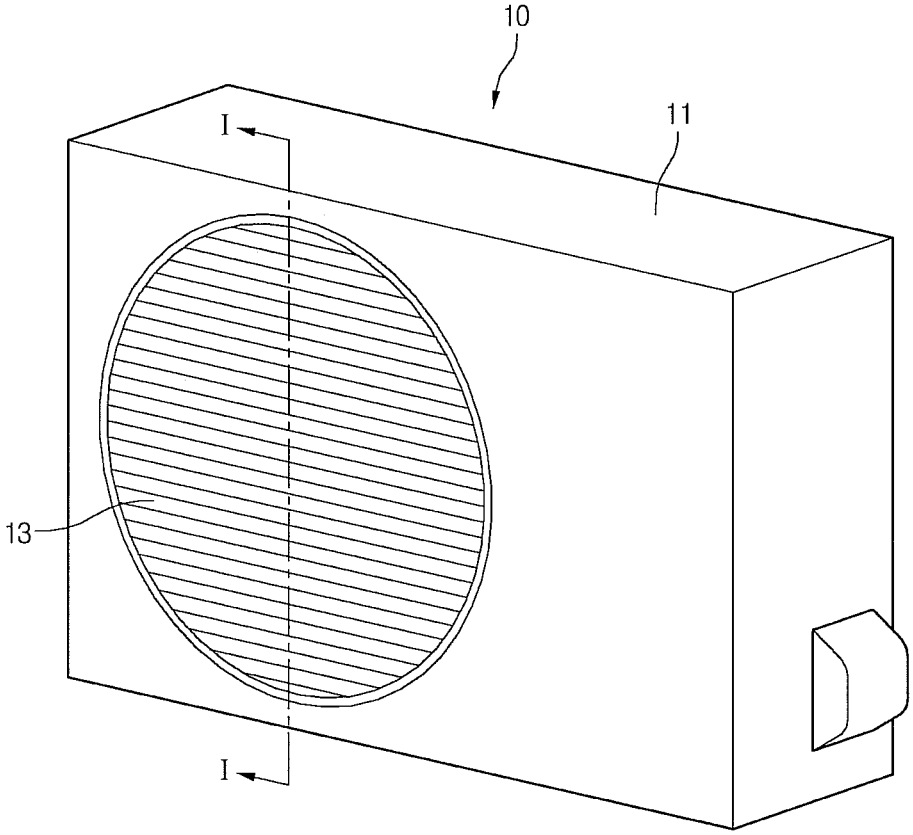
FIG. 2 is a front perspective view of an outdoor unit showing a condition in which a discharge port is closed.

FIG. 1 is a front perspective view of an outdoor unit showing a condition in which a discharge port is opened, as an outdoor unit for an air conditioner according to an exemplary embodiment of the disclosure and FIG. 2 is a front perspective view of an outdoor unit showing a condition in which a discharge port is closed.

In FIG. 1 and FIG. 2, an outdoor unit 10 for an air conditioner of an exemplary embodiment of the disclosure includes a case 11 forming a shape, a heat exchanger (not shown) accommodated inside the case, and a fan 14 (refer to FIG. 3) arranged in front of the heat exchanger.

In detail, an discharge port 111 is formed in a front of the outdoor unit 10 and a suction port (not shown) is formed in a side of the outdoor unit 10. Further, a discharge grille 12 is formed in the discharge port 111 and blocks putting your hands or entering bulky foreign substance from the outside. The discharge grille 12 may be composed by a combination of a plurality of ribs extending in all directions from a center of the discharge port 111 and a plurality of circular ribs having a diameter different from each other. However, it is revealed that the discharge grille 12 is not limited to the same structure as above. In addition, the discharge grille 12 is fixed to the front of the case 11 i.e. an edge of the discharge port 111. Alternatively, the discharge grille 12 may be made in one body with the case 11.

In addition, a plurality of louvers 13 can be installed rotatably in the front of the discharge grille 12. When not driving the outdoor unit 10, the upright louvers 13 close perfectly the discharge ports 111, and the outdoor unit 10 rotates frontward during its driving process to allow the discharge port 111 to be opened.

Hereinafter, the structure and operations of the louvers 13 will be described in detail with reference to drawings.

Figure 3:
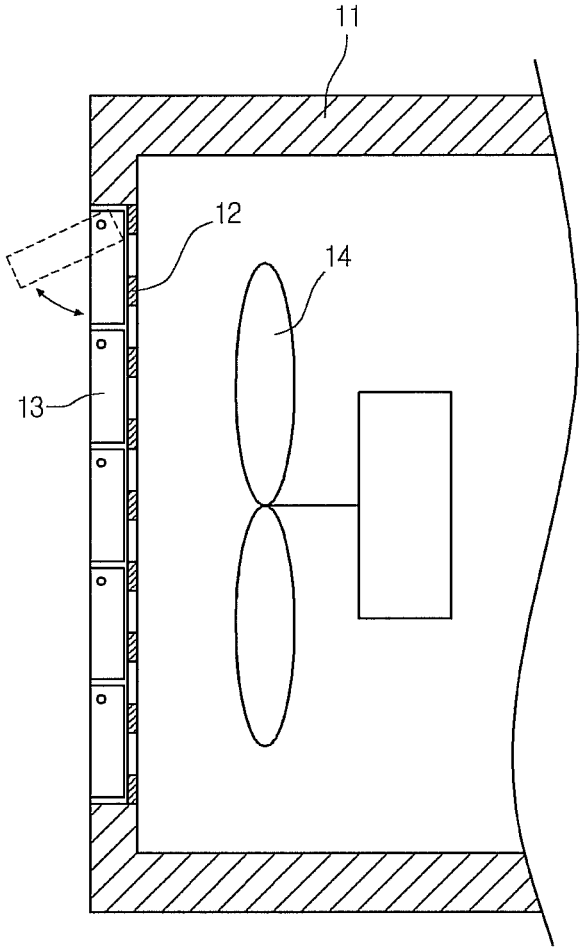
FIG. 3 show a louver structure according to a first embodiment of the disclosure, as a cross-sectional view taken along line I-I of FIG. 2.

FIG. 3 shows a louver structure according to a first embodiment of the disclosure, as a cross-sectional view taken along line I-I of FIG. 2.

In FIG. 3, the plurality of louvers 13 can be placed horizontally or vertically. In addition, the louvers 13 close perfectly the discharge port 111 under condition parallel to the front of the case 11.

In detail, both ends of each of the plurality of louvers 13 are rotatably connected to the edge of the discharge port 111. First, it is described that the plurality of louvers 13 are placed in the horizontal direction and arranged adjacently to each other in the vertical direction.

When the plurality of louvers 13 are placed in the horizontal direction, a rotation axis may be protruded from both side ends of each louver 13. In addition, the rotation axis may be formed in the top end of the side end of the louvers 13. According to such a structure, when the fan 14 is driven and the suctioned outdoor air is discharged to the discharge port 111, the louvers 13 rotate frontward by air pressure to be discharged above. Further, if the fan 14 is stopped, each of the louvers 13 returns to its original position by gravity to maintain an upright condition. When the louvers 13 is in the upright condition, the discharge port 111 is completely closed. Therefore, there is a advantage that a separate driving mechanism rotating the louvers 13 is not needed.

In addition, since the discharge grille 12 is arranged in the rear of the louvers 13, when the fan 14 is stopped, a phenomenon that the louvers 13 rotate inside the outdoor unit 10 can be prevented by wind blowing into the inside of the outdoor unit 10 from the outside of the outdoor unit 10.

On the other hand, when the louvers 13 are vertically combined to the discharge port 111, since it is impossible to rotate due to gravity of the louvers 13, the rotation axis of the louvers 13 is equipped with elastic members such as a torsion spring at this time. In other word, when wind pressure generated by driving of the fan 14 acts to the louvers 13, the louvers 13 rotate frontward. Then, when the fan 14 is stopped, the louvers 13 may return to its original position by force of restoration of the elastic member (refer to FIG. 10).

Alternatively, the driving mechanism to allow the louvers 13 to rotate selectively will be applied. The description about this will be described with reference to the drawings below.

Figure 4:
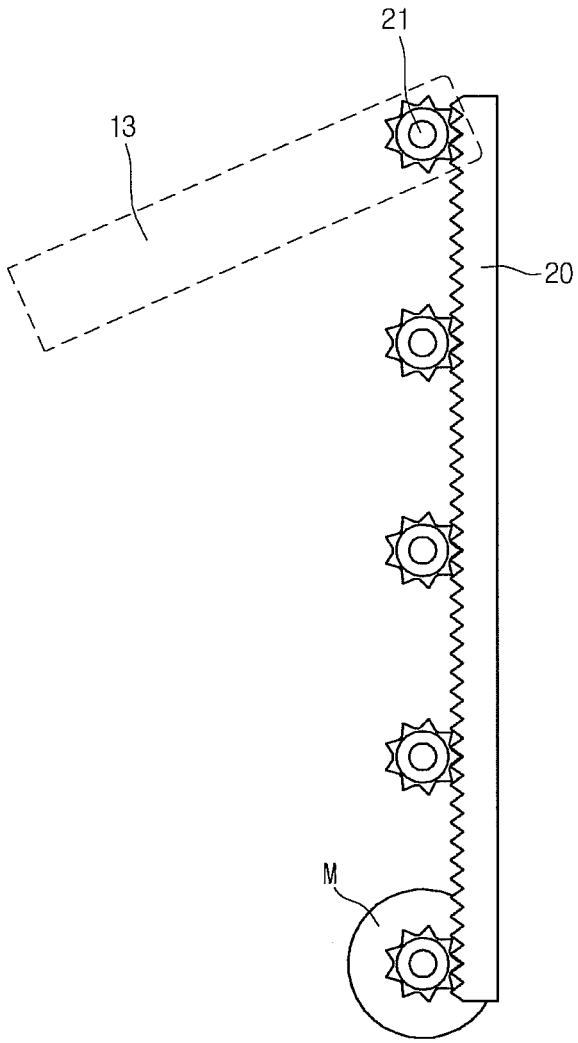
FIG. 4 shows schematically a louver driving mechanism according to a second embodiment of the disclosure.
Figure 5:
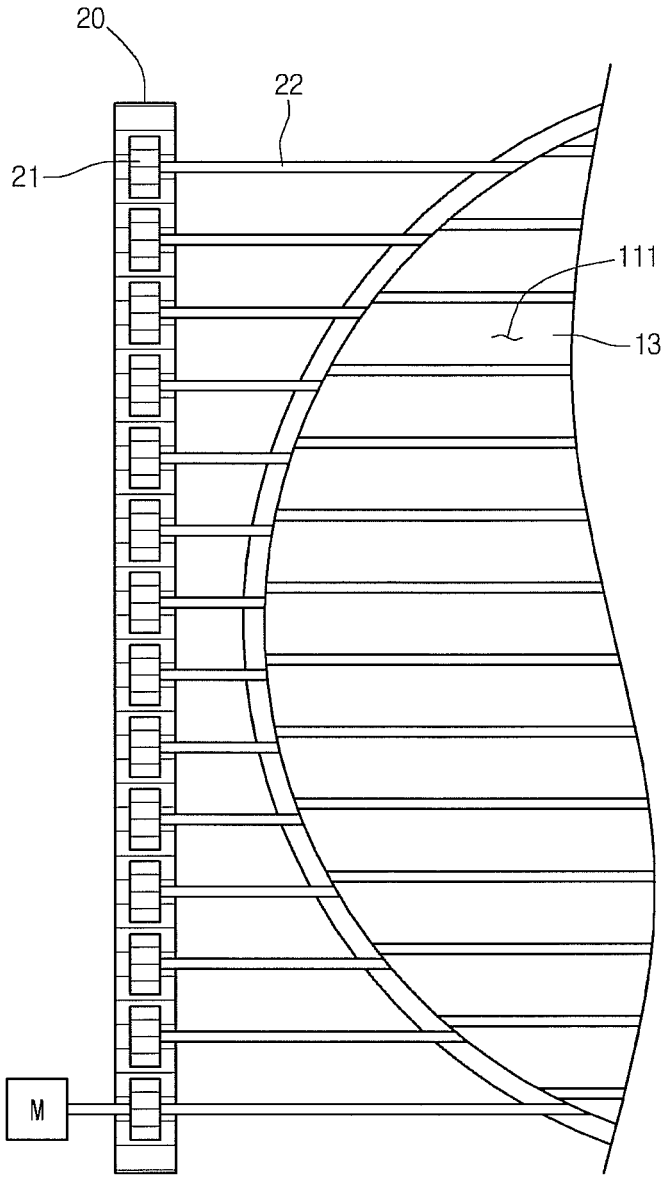
FIG. 5 shows a portion of the rear of the outdoor unit case equipped with the louver driving mechanism.
Figure 6:
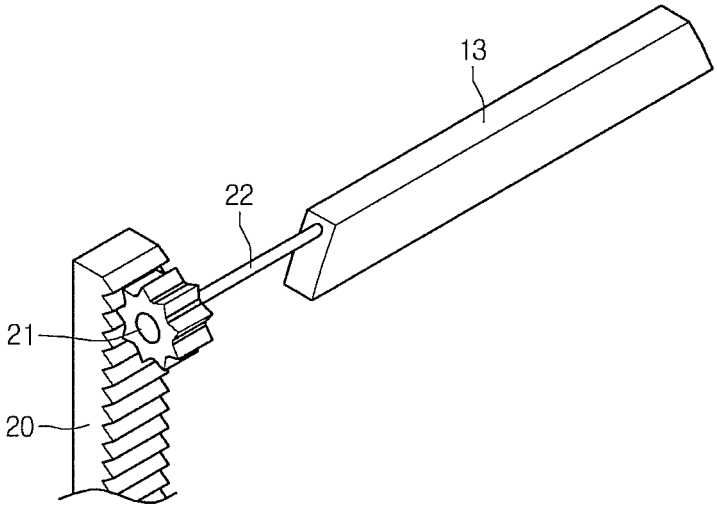
FIG. 6 shows schematically a form in which the louver is connected to the louver driving mechanism.

FIG. 4 shows schematically a louver driving mechanism according to a second embodiment of the disclosure, FIG. 5 shows a portion of the rear of the outdoor unit case equipped with the louver driving mechanism and FIG. 6 shows schematically a form in which the louvers are connected to the louver driving mechanism.

In FIG. 4 to FIG. 6, A connection bar 22 is extended to one or both ends of the louvers 13 and a pinions 21 is mounted in the end of the connection bar 22. In addition, a racks 20 may be arranged in the front or rear of the pinions 21. Further, the pinions 21 may be gear-coupled with the racks 20. The racks 20 is formed with lengths that may be gear-coupled with both of the pinions 21 connected to uppermost louvers 13 and the pinions 21 connected to lowermost louvers 13. Further, the racks 20 may be mounted inside the case 11 to enable reciprocal movement along the length of the racks 20.

Further, a driving motor M may be connected to any one of the pinions 21 connected to the louvers 13, for example, the lowermost or uppermost pinions 21.

According to such a configuration, when the driving motor M is operated, the pinions 21 connected to the driving motor M rotates. Further, the racks 20 engaged with the pinions 21 is moved upward or downward on the drawings. Therefore, another pinions gear-coupled with the rack 20 rotate together, too, such that the entire louvers 13 rotate at the same rotational speed and the discharge port 111 is opened or closed selectively.

On the other hand, another mechanism in addition to the rack and pinion structure may be applied as a method for rotating simultaneously a plurality of the pinion 21 connected to the louvers 13, respectively. For example, time belt type belts may be applied instead of the rack 20. In other words, gear teeth are formed in inner principal plan of the belt and the plurality of pinions 21 may be engaged with the gear teeth formed in inner principal plan of the belt. Further, when the driving motor is connected to the uppermost or the lowermost pinion 21, another pinions 21 also rotate at the same speed according to the rotation of the belt.

Further, in addition to the time belt type belt, a chain type sprocket assembly may be applied.

The pinion described above is called "a first power delivery member" and the rack, the time belt or the sprocket assembly is called "a second power delivery member".

Figure 7:
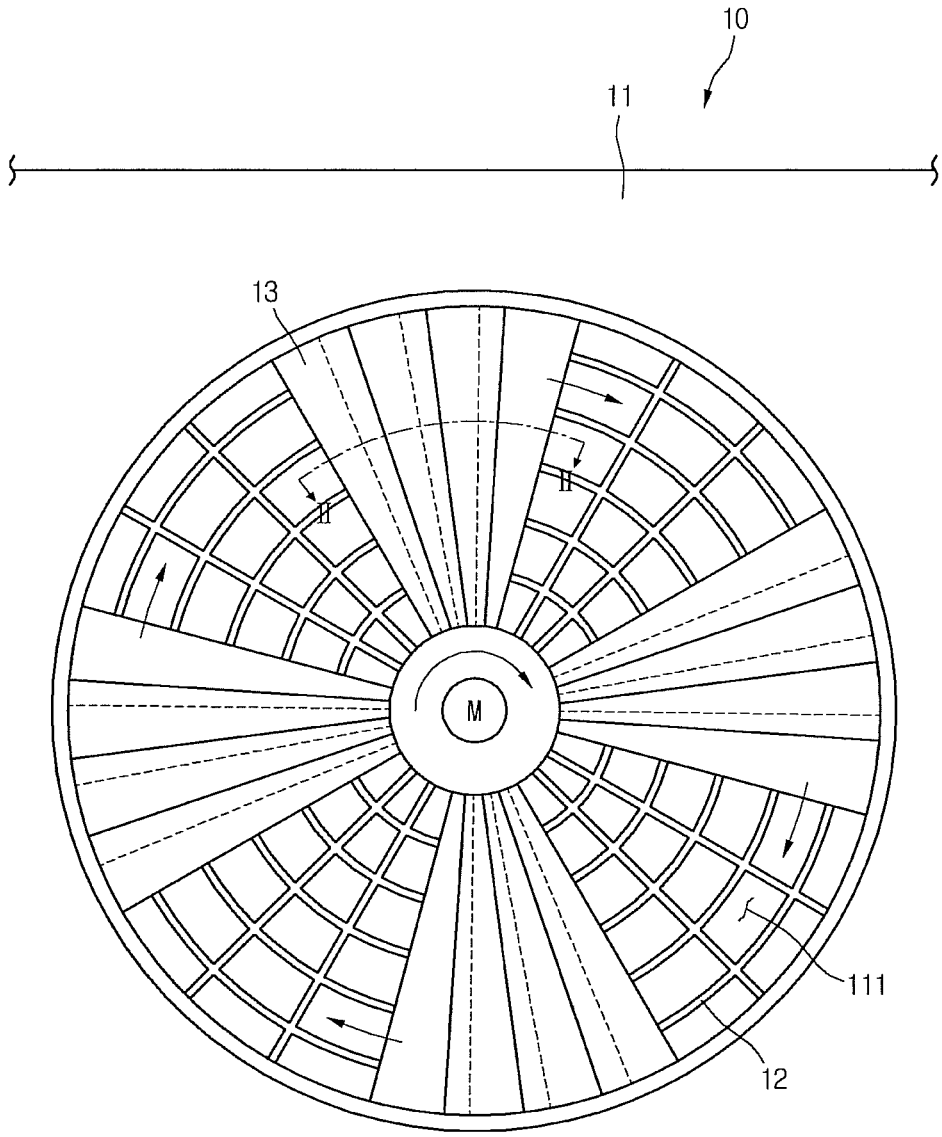
FIG. 7 is a front view of the outdoor unit showing schematically the louver driving mechanism according to a third embodiment of the disclosure.
Figure 8:
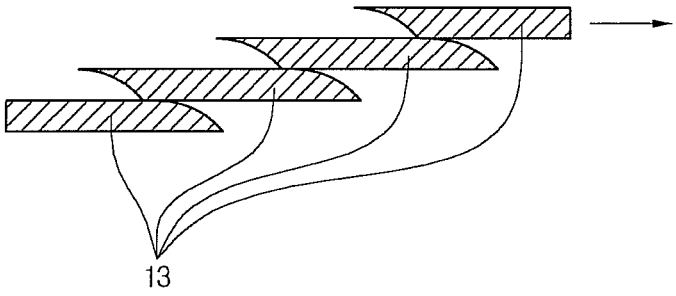
FIG. 8 is a cross-sectional view showing a process in which the louvers close the discharge port of the outdoor unit, as a cross section view taken along line II-II of FIG. 7.
Figure 9:
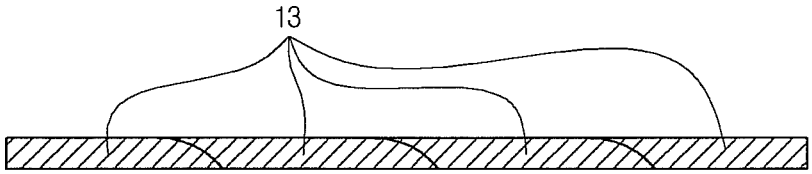
FIG. 9 is a cross-sectional view showing a condition when the louvers close perfectly the discharge port of the outdoor unit.

FIG. 7 is a front view of the outdoor unit showing schematically the louver driving mechanism according to a third embodiment of the disclosure, FIG. 8 is a cross-sectional view showing a process in which the louvers close the discharge port of the outdoor unit, as a cross section view taken along line II-II of FIG. 7 and FIG. 9 is a cross-sectional view showing a condition when the louvers close perfectly the discharge port of the outdoor unit.

Referring to FIG. 7 to FIG. 9, the discharge port 111 of the outdoor unit 10 according to the disclosure may be selectively closed by the plurality of louvers 13 extending in all directions. The plurality of louvers 13 may be arranged to be overlapped with each other. In other word, a portion of one louver may be arranged to be vertically overlapped with a portion of another louver (refer to FIG. 8).

Specifically, the driving motor may be mounted in the center of the discharge grille 12 and the louver assembly having a fan type may be mounted in the front of the discharge grille 12. In other words, the louver assembly, in which the plurality of louvers 13 having the fan type are connected to each other, is mounted and the inner end of the louver 13 connected to its edge is connected to the rotation axis of the motor M. According to this configuration, as shown in FIG. 7 and FIG. 8, when the driving motor M is rotated to rotate the louvers 13 connected to the edge, the discharge port 111 is closed while unfolding the plurality of louvers 13 in a fan type.

Further, the discharge port 111 may be perfectly closed by unfolding one louver assembly circularly and as shown in FIG. 7, short louver assemblies are provided in combined type to enable the discharge port 111 to be closed. For example, the discharge port 111 is to be quartered and four louver assemblies may be circularly surrounded in the inside of the discharge port 111. Further, each louver 13 situated at the edge are connected to the rotation axis of the driving motor M. In this condition, when the driving motor M rotates, four louver assemblies cover by ¼ of the discharge port 111 area to perfectly close the discharge port 111 in total.

On the other hand, one side of each louver 13 is convexly rounded as shown in FIG. 8 and FIG. 9 and the other side is concavely rounded. Then, when the louver assembly is in fully unfolded condition as shown in FIG. 9, there is no gap between adjacent louvers. In other words, the plurality of louvers may be arranged in one column side by side without overlapping with each other.

In addition, when the louver assembly is in the folding process, one of the louvers 13 is smoothly sled along the side of the adjacent louvers 13 so as to be positioned on the rear of the adjacent louvers 13.

Figure 10:
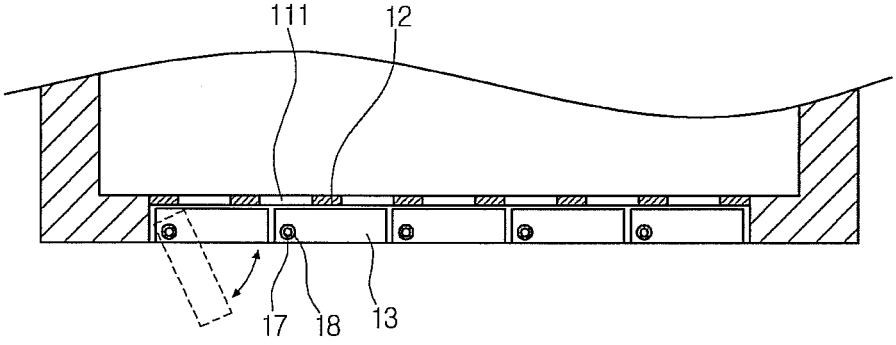
FIG. 10 shows the louver structure according to a fourth embodiment of the disclosure

FIG. 10 shows the louver structure according to a fourth embodiment of the disclosure.

In the FIG. 10, the louvers 13 according to the fourth embodiment of the disclosure may be rotatably coupled with the discharge port 111 vertically.

The louvers 13 are provided with the rotation axis 17 forming the rotation center of the louvers 13. An elastic member 18 providing force of restitution to the louvers 13 is coupled with the rotation axis 17. The elastic member 18 includes a torsion spring.

When the fan 14 rotates, the louvers 13 overcome the elastic force of the elastic member 18 so as to rotate with one direction. Further, the discharge port 111 is opened and air of the inside of the outdoor unit 10 is discharged outside.

On the other hand, when the driving of the fan 14 is stopped, the louvers 13 rotate at its original position by force of restoration of the elastic member 18 so as to close the discharge port 111.

In summary, when wind pressure generated by driving of the fan 14 acts to the louvers 13, the louvers 13 rotates frontward. Then, when the fan 14 is stopped, the louvers 13 may return to its original position by force of restoration of the elastic member.

In such a configuration, opening and closing of the louvers 13 may be easily achieved by a simple configuration.

What is claimed is:

1. An outdoor unit for an air conditioner, comprising:

a case including a suction port suctioning outside air and a discharge port discharging the suctioned air;

a heat exchanger accommodated inside the case;

a fan that is accommodated inside the case and forcibly circulate the air;

a louver assembly rotatably mounted in the case so as to selectively open and close the discharge port, the louver assembly including a plurality of louvers connected to each other at their inner side ends so as to be rotatable; and a driving motor including a rotation axis connected to inner side ends of each of the plurality of louvers, the driving motor configured to fold or unfold the plurality of louvers along a rotation direction of the rotation axis, and wherein the plurality of louvers includes a first louver, a second louver and a third louver, the first louver including a first inner side end, the second louver including a second inner side end, and the third louver including a third inner side end, wherein the first inner side end, the second inner side end and the third inner side end being all commonly connected, the first louver having a first side surface and a second side surface, the first side surface being convexly rounded between a first top surface and a first bottom surface of the first louver, and the second side surface being concavely rounded between the first top surface and the first bottom surface of the first louver, and the second louver having a third side surface and a fourth side surface, the third side surface being convexly rounded between a second top surface and a second bottom surface of the second louver, and the fourth side surface being concavely rounded between the second top surface and the second bottom surface of the second louver, the second side surface of the first louver moves on the third side surface of the second louver when at least one of the first and second louver moves along a direction perpendicular to an airstream discharged through the discharge port, and the first bottom surface of the first louver, the second bottom surface of the second louver and a bottom surface of the third louver form a common plane when the louver assembly is provided into a fully extended position based on the driving motor driving the louver assembly.

2. An outdoor unit for an air conditioner according to claim 1, further comprising a discharge grille provided at one side of the louver assembly.

3. An outdoor unit for an air conditioner according to claim 1, wherein each of the plurality of louvers has a fan shape extending from a center of the discharge port.

* * * * *